United States Patent [19]

Staerzl

[11] Patent Number: 4,711,219

[45] Date of Patent: Dec. 8, 1987

[54] THROTTLE-POSITION SIGNAL GENERATOR FOR AN ELECTRONIC FUEL-INJECTION SYSTEM

[75] Inventor: Richard E. Staerzl, Fond du Lac, Wis.

[73] Assignee: Brunswick Corporation, Skokie, Ill.

[21] Appl. No.: 889,080

[22] Filed: Jul. 24, 1986

[51] Int. Cl.[4] ..... F02D 41/18

[52] U.S. Cl. ..... 123/494; 123/488

[58] Field of Search ..... 123/478, 488, 494

[56] References Cited

U.S. PATENT DOCUMENTS

| | | | |
|---|---|---|---|
| 3,908,614 | 9/1975 | Ironside et al. | 123/494 X |
| 4,280,465 | 7/1981 | Staerzl | 123/494 |
| 4,391,250 | 7/1983 | Matsui | 123/494 X |
| 4,561,404 | 12/1985 | Kanno et al. | 123/494 X |

*Primary Examiner*—Willis R. Wolfe, Jr.

*Attorney, Agent, or Firm*—Hopgood, Calimafde, Kalil, Blaustein & Judlowe

[57] ABSTRACT

A signal generator provides a non-linear fuel-control output signal, in response to an analog input-voltage signal which is linearly related to throttle setting. A multi-step switch divides into equal increments the full range of possible throttle-setting signals, and, in conjunction with a resistor network, provides a stepped output, the progression of which is a non-linear function of throttle setting. A dither circuit produces an oscillating sawtooth voltage of amplitude scaled to a one-step increment, and addition of this voltage to the throttle-setting voltage is effective to produce a smooth and effectively continuous non-linear output of the resistor network. A smoothing circuit at output of the resistor network yields a d-c output which is non-linearly related to the throttle setting. Non-linearity can be designed to various requirements merely by selection of component values in the resistor network, without change of the switch and without modifying or adjusting any of the componentry for input-signal supply to the switch.

7 Claims, 3 Drawing Figures

THROTTLE-POSITION SIGNAL GENERATOR FOR AN ELECTRONIC FUEL-INJECTION SYSTEM

BACKGROUND OF THE INVENTION

The invention relates to electronic fuel-injection circuitry for internal-combustion engines and is more particularly concerned with generation of suitable throttle-responsive fuel-flow control signals used in such circuitry.

Reference is made to my U.S. Pat. Nos. 3,305,351 and 4,349,000 for detailed discussion of pulse-width modulating circuitry for operation of the solenoids of fuel-injectors in a variety of engines of the character indicated. The disclosure in said patents, for example in connection with FIG. 6 of said U.S. Pat. No. 4,349,000, is concerned with circuit accommodation of various input parameters, in the form of analog voltages which reflect air-mass flow for the current engine speed, and a correction is made for volumetric efficiency of the particular engine, to arrive at a pulse-width modulating voltage $E_{MOD.}$ in a line to each of two like square-wave pulse generators. These pulse generators respectively serve for fuel-injection control in different groups of cylinders in the involved engine. The input parameters further include engine speed and throttle setting but there is no disclosure of a particular relationship between throttle setting and the requisite electrical-signal response to throttle position.

Ordinarily, each engine will have its own optimum requirement for a fuel-flow control signal which has a particular non-linear relation to throttle position. The degree of non-linearity will depend upon engine size and the nature of power demands expected in normal use of the engine. Thus, a particular non-linearly related signal generated for one engine may not be suitable for operational requirements of another engine. As a consequence, a variety of specialpurpose position-transducer and circuit-design configurations must be available in inventory if the engine manufacturer, for example, a marine-outboard engine manufacturer, is to be able to satisfy customer demand despite the high seasonal fluctuations in such demand.

BRIEF STATEMENT OF THE INVENTION

It is an object of the invention to provide improved circuitry for translating throttle position into a non-linearly related fuel-flow control signal, for engines of the character indicated.

It is a specific object to meet the above object with a combination of components which with little modification is adaptable to serve a wide variety of different-engine requirements.

Another specific object is to meet the above objects with circuitry utilizing linear analog voltage response to throttle position.

The invention meets the above objects and provides certain further advantageous features in a circuit combination which relies upon a linear sensor to provide a circuit-input voltage which is strictly linearly responsive to throttle position. In the case of the marine outboard engines to which the invention has been applied, throttle position is generally recognized in terms of the angular setting of the throttle-control arm. Reference herein to throttle angle must therefore be understood to be merely illustrative and not limiting.

The throttle-angle sensor supplies a linear analog voltage to a multiple-step analog switch, having plural output connections to a resistor network, wherein the resistors are selected to be of different relative value such that the voltage output of the resistor network is non-linearly stepped in relation to the linear throttle-angle voltage applied to the switch input, while each step represents an equal step-divided fraction of the total range of throttle settings. If the switch has a sufficiently large number of steps, the fact that the non-linear voltage output of the resistor network is stepped is of relatively minor consequence. However, the invention contemplates a more modest number of switching steps and provides means whereby the output voltage of the resistor network is converted into a continuous function, exhibiting the desired non-linearity. This conversion is accomplished by summing the throttle-angle sensor voltage with a locally generated oscillating sawtooth voltage which has an amplitude equal to one step, the thus-summed sawtooth-modulated voltage being applied to the input of the multi-step switch. A smoothly continuous output signal, non-linearly related to throttle-angle position, results from filter-smoothing action on the output of the resistor network.

This smooth and continuous non-linear signal is a d-c signal, whatever the choice of resistor values to achieve particular desired non-linearity via the resistor network. The circuit of the invention is thus applicable to a wide variety of different non-linearity requirements, merely by proper choice of network-resistor values, and no change, adjustment or modification is needed in the analog side of the system, or in the multi-step switch itself.

DETAILED DESCRIPTION OF A PREFERRED EMBODIMENT

The invention will be described in detail in conjunction with the accompanying drawings, in which.

Figure 1:
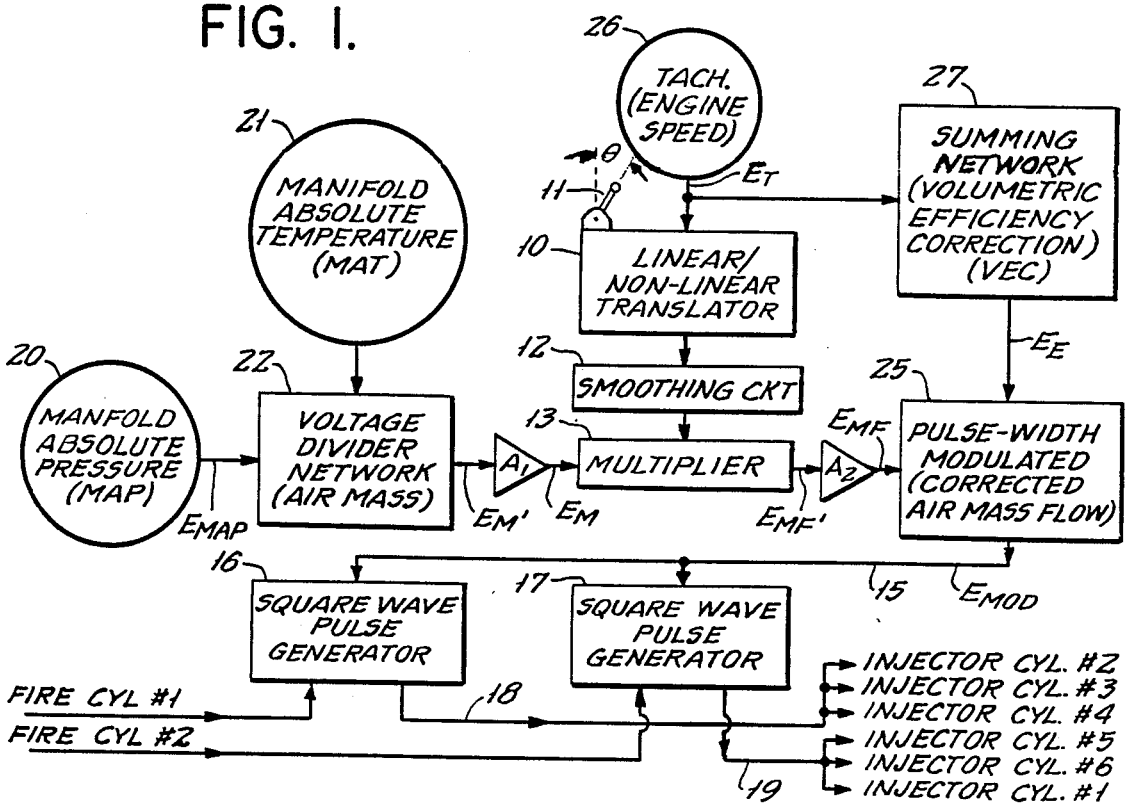
FIG. 1 is an electrical block diagram, schematically indicating components of circuitry of the invention, in the context of other components of fuel-injection control circuitry, applicable to a variety of different fuel-injection engines.

The diagram of FIG. 1 is similar to FIG. 6 of said U.S. Pat. No. 4,349,000, in order to show context for FIG. 2 circuitry of the invention, the same being indicated in FIG. 1 as a linear/non-linear translator 10, operative upon tachometer voltage $E_T$ and reflecting the currently set angle of throttle control 11, the voltage output of translator 10 being smoothed at 12 to provide a d-c voltage for multiplication at 13 with a voltage $E_M$, and the product of multiplication being a fuel-control voltage $E_{MF}$; in other words, the elements 10, 11, 12 and 13 of FIG. 1 replace the potentiometer 53 and throttle control 54 of FIG. 6 of said patent.

As suggested by legends in FIG. 1, the circuit of FIG. 1 is shown in application to the development of fuel-injection voltage pulses for operation of a two-cycle V-6 engine described in detail in said U.S. Pat. No. 4,349,000, and said circuit operates on various input parameters, in the form of analog voltages which reflect air-mass flow for the current engine speed, a correction being made for volumetric efficiency of the particular engine, to arrive at a modulating-voltage output $E_{MOD.}$ in a line 15 to each of two like square-wave pulse generators 16–17. Depending upon the magnitude of the modulating voltage $E_{MOD.}$ in line 15, the square-wave output at 18 will be of predetermined duration, and the square-wave output at 19 will be of duration identical to that in line 18, it being understood that the predetermined duration is always a function of instantaneous engine-operating conditions.

More specifically, for the circuit shown, a first electrical sensor 20 of manifold absolute pressure is a source of first voltage $E_{MAP}$ which is linearly related to such pressure, and a second electrical sensor 21 of manifold absolute temperature may be a thermistor which provides a voltage linearly related to such temperature, through a resistor network 22. The voltage $E_{MAP}$ is divided by the network 22 to produce an output voltage $E_M$, which is a linear function of instantaneous air-mass or density at inlet of air to the engine. A first amplifier $A_1$ provides the output voltage $E_M$ which is one of the inputs to multiplier 13. The voltage product $E_{MF}$, of multiplier 13 reflects instantaneous air-mass flow for the instantaneous throttle (11) setting and engine speed, and a second amplifier $A_2$ provides a corresponding output voltage $E_{MF}$ for application to one of the voltage-multiplier inputs of a modulator 25, which is the source of $E_{MOD.}$ The other voltage-multiplier input of modulator 25 receives an input voltage $E_E$ which is a function of engine speed (tachometer 26) and volumetric efficiency (network 27).

Figure 2:
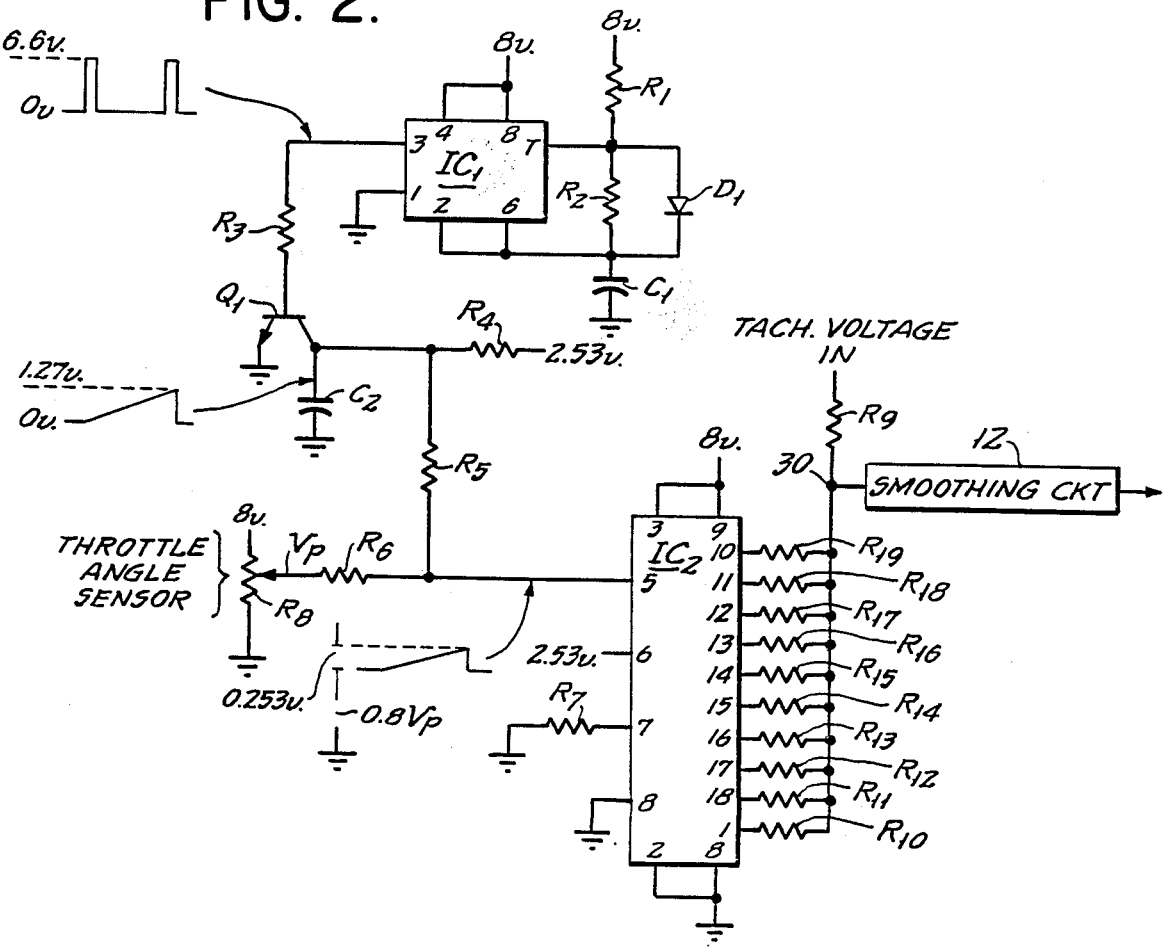
FIG. 2 is a more explicit circuit diagram to show detail of the component combination of the invention.

Referring now to FIG. 2, a linear throttle-angle sensor is shown as a potentiometer $R_8$ with an applied regulated voltage of 8 volts and therefore developing an output voltage $V_p$ which is linearly related to the instantaneous throttle-angle setting $\theta$. This voltage $V_p$ is applied, via a resistor $R_6$, to a multiple-step analog switch in the form of an integrated circuit element $IC_2$; this switch may be a National LM 3914 integrated circuit, in which case the input analog voltage from angle sensor $R_8$ is applied to pin 5, as shown. Switch $IC_2$ senses input analog-voltage levels and drives appropriate load resistors, there being ten outputs (pins 10 to 18, and 1) and a different load resistor ($R_{10}$ to $R_{19}$) connected to each of these outputs. The switch shown thus divides the full spread of possible output votlage from sensor $R_8$ into ten equal steps. The full input range of voltage acceptable to switch $IC_2$ is determined by a regulated fixed voltage applied to pins 4 and 6, here shown to be 2.53 volts, so that each of the analog steps recognizable by this particular switch is a 0.253-volt step. As input voltage (at pin 5) increases in value, the output resistors are sequentially clamped to ground through pins 10 to 18, and 1; and the voltage which is thus sequentially clamped is the tachometer (26) voltage via a resistor $R_9$, connected in common to all the resistors $R_{10}$ to $R_{19}$ of the resistor-network governed by switch action. It is to be understood that the values of these resistors $R_{10}$ to $R_{19}$ are selected to provide particular multi-stepped non-linear translation of the linear input function of switch $IC_2$, this stepped voltage output being available at the output terminal 30 of the resistor network $R_{10}$ to $R_{19}$. The particular non-linearity will be further understood to be a function of particular engine design and performance specifications.

While it is possible with a large number of switching steps to achieve a tolerable non-linear fuel-control signal, it is preferable to avoid such steps in output voltage, by converting the step function into an effectively continuous function. The invention provides this result through use of a dither circuit which produces an oscillating sawtooth voltage having an amplitude which is a submultiple of the input analog range (pins 4 and 6) of switch $IC_2$, where the submultiple is the number of switching steps, namely ten, in the present illustration. The dither circuit averages the steps into an effectively continuous transfer function, by cyclically summing the signal from the throttle-angle sensor with a sawtooth voltage having an amplitude equal to a step. And the sawtooth frequency of oscillation is well above the highest frequency of fuel-injector operation, even at full engine speed.

In the form shown, the dither circuit relies on a commercial integrated-circuit timer element $IC_1$, which may be an NE 555 timer, to generate a recurrent succession of pulses, illustratively at 6.6 volts and with a recurrence frequency of kilohertz magnitude, for triggering discharge of a transistor $Q_1$. Transistor $Q_1$ discharges a capacitor $C_2$, which is then allowed to charge through a resistor $R_4$. The recurrent (oscillating) sawtooth voltage that is generated by this action is summed with the throttle-angle voltage $V_p$ through a resistor network $R_5$ and $R_6$, and the result is applied to the analog-switch input (pin 5). The scale of the thussummed voltage, at input to switch $IC_2$, is such that the full 8-volt range of angle sensor $R_8$ corresponds to the full 2.53-volt preselected analog-input range of switch $IC_2$; and as has already been noted, the scale of sawtooth-voltage amplitude, as superposed on the scaled sensor-output voltage, is 0.253 volt at input to the switch. Suitably, for values already expressed, the values of resistors $R_5$ and $R_6$ are 1 megohm and 10 kilohms, respectively.

Figure 3:
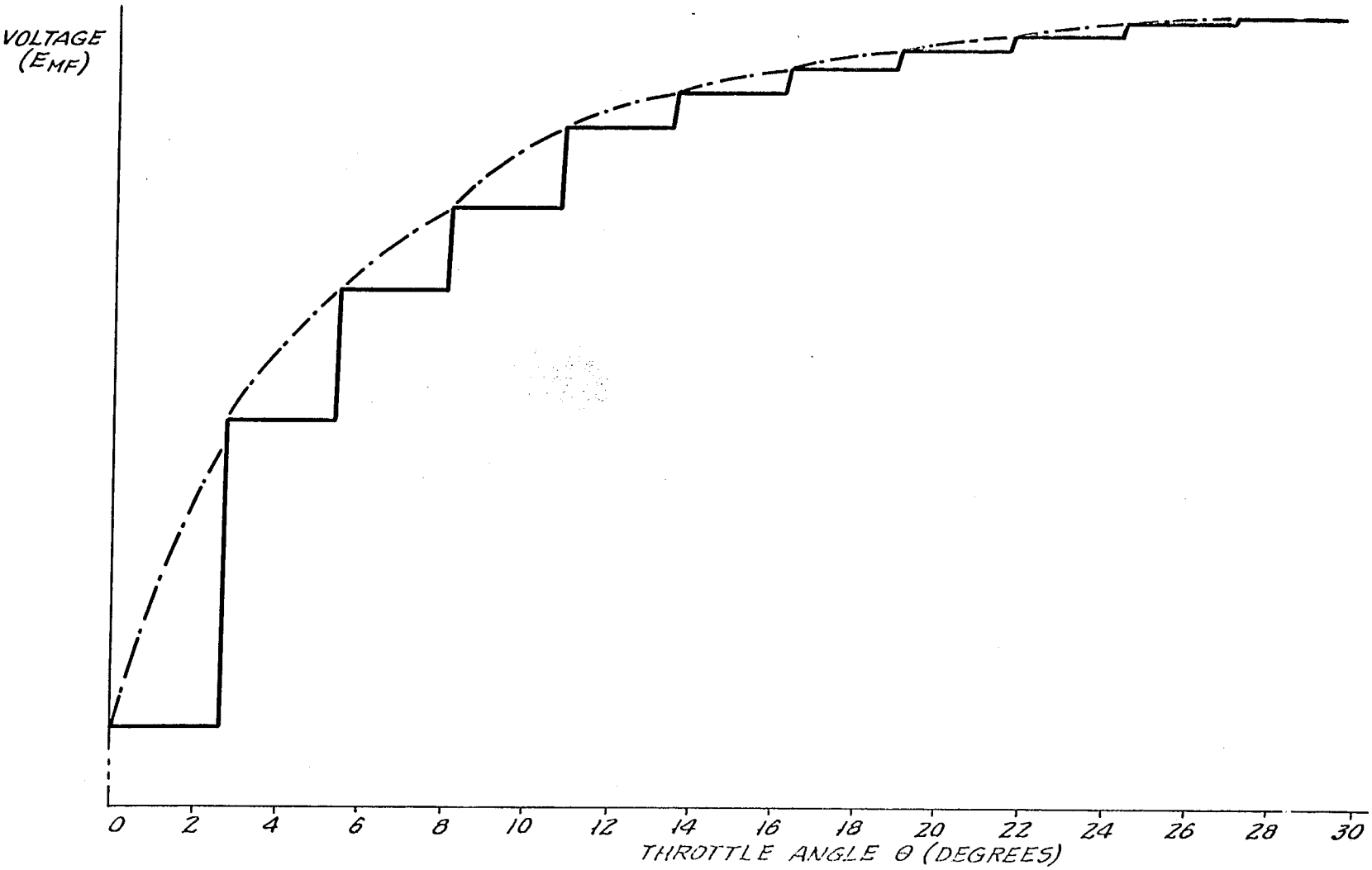
FIG. 3 is a graph showing a voltage-output characteristic achieved by the invention, as a function of throttle-angle position.

FIG. 3 illustrates a typical non-linear relation between output voltage $E_{MF}$ and throttle angle $\theta$, as produced by disclosed components. Without the dither circuit, the non-linear function is characterized by the ten steps of switch ($IC_2$) action in conjunction with its particular output-resistor network $R_{10}$ through $R_{19}$, as shown by solid line in FIG. 3. With the dither circuit, in conjunction with the smoothing action of circuit 12, the non-linear relation is smoothly and continuously defined so as to effectively eliminate any sign of step action, as shown by the phantom-line course of FIG. 3.

The described invention will be seen to achieve all stated objects, and it is particularly to be noted that the smoothing continuous-function translating action of the summed angle-sensor and dither voltages in cooperation with the switch is generically applicable, without adjustment or change of components, to the production of an infinite variety of non-linear outputs, depending upon the selection of resistor values in the network $R_{10}$ to $R_{19}$.

While the invention has been described in detail for a preferred embodiment, it will be understood that modifications may be made without departing from the claimed scope of the invention.

What is claimed is:

1. In combination, for use in generation of a fuel-injection control signal which is a non-linear function of throttle position, throttle-tracking means linearly tracking throttle position and producing an analog output voltage which is a linear function of throttle position, an oscillating sawtooth generator producing an output sawtooth voltage of amplitude which is a submultiple of said analog output voltage at full-throttle position, summing means connected to said throttle-tracking means and to said sawtooth generator and producing a summed-voltage output, a multi-step analog switch having an input connected to said summed-voltage output, the number of steps of said switch being equal to said submultiple, said switch having a least an output connection for each of said steps, and a resistance network comprising individual resistors of differing value connected at first ends to the respective outputs of said switch, said network having an output connection in common to the opposite ends of said resistors.

2. The combination of claim 1, further including a smoothing device connected to the output of said resistance network.

3. In an electronic fuel-injection control circuit wherein a potentiometer tracks throttle setting in the generation of an electrical signal for pulse-width modulation of a square-wave generator of fuel-injector excitation pulses, the improvement wherein (a) the potentiometer is a linear analog device, (b) a multi-step analog switch and associated resistor network are connected to the potentiometer to provide an electrical-signal output which is a non-linear function of the throttle setting, and (c) an oscillating sawtooth generator produces an output sawtooth voltage of amplitude substantially equal to a submultiple of maximum potentiometer voltage output, wherein the submultiple is the number of steps of said switch, the voltage outputs of said potentiometer and generator being summed for connection to said multi-step switch, whereby the otherwise-stepped non-linear output of the resistor network is effectively available as a continuous function of throttle setting, for generation of the pulse-width-modulating signal.

4. The improvement of claim 3, in which the output of said resistor network includes a smoothing circuit for establishing said effectively continuous function as a d-c voltage.

5. The improvement of claim 3, in which the number of steps of said multi-step analog switch is at least 5.

6. The improvement of claim 3, in which the number of steps of said multi-step analog switch is 10.

7. The improvement of claim 3, in which the sawtooth frequency of said generator is of kilohertz magnitude.

* * * * *